United States Patent [19]

Farrar

[11] Patent Number: 4,998,876

[45] Date of Patent: Mar. 12, 1991

[54] COMBUSTION OF LIQUID HYDROCARBONS

[75] Inventor: David H. Farrar, Scarborough, Canada

[73] Assignee: Velino Ventures Inc., Toronto, Canada

[21] Appl. No.: 391,434

[22] Filed: Aug. 9, 1989

Related U.S. Application Data

[63] Continuation-in-part of Ser. No. 232,390, Aug. 15, 1988, abandoned.

[51] Int. Cl.[5] ..... F23J 7/00

[52] U.S. Cl. ..... 431/3; 431/4; 44/358

[58] Field of Search ..... 431/3, 4; 44/68; 556/143, 146

[56] References Cited

U.S. PATENT DOCUMENTS

| | | | |
|---|---|---|---|
| 3,122,577 | 2/1964 | Lindstrom et al. | 556/143 |
| 3,282,858 | 11/1966 | Simmons . | |
| 3,294,685 | 12/1966 | Stevens . | |
| 3,341,311 | 9/1967 | Pedersen | 44/69 |
| 3,535,356 | 10/1970 | Hartle et al. | 556/143 |
| 4,222,746 | 9/1980 | Sweeney . | |
| 4,389,220 | 6/1983 | Kracklauer . | |

FOREIGN PATENT DOCUMENTS

| | | |
|---|---|---|
| 2500683 | 7/1976 | Fed. Rep. of Germany . |
| 1028586 | 2/1986 | Japan . |

OTHER PUBLICATIONS

"$NO_x$ Emission Controls for Heavy Duty Vehicles: Toward Meeting a 1986 Standard", National Research Council (1981).

"$NO_x$ Control for Stationary Combustion Sources", Sarafin and Flagan, Pro. Energy Combustion Science, vol. 2, pp. 1–25, 1976.

*Primary Examiner*—Larry Jones

*Attorney, Agent, or Firm*—Basile and Hanlon

[57] ABSTRACT

A process for improving combustion of liquid hydrocarbons and reducing $NO_x$ emissions. The process comprises burning the liquid hydrocarbon in the presence of an additive composition to improve measurably the combustion efficiency. The additive composition comprises a dicyclopentadienyliron compound in combination with a suitable organic solvent. By virtue of using the additive compound, the excess air requirements can be adjusted downwardly to reduce $NO_x$ emissions in combustion products.

12 Claims, No Drawings

COMBUSTION OF LIQUID HYDROCARBONS

This application is a continuation-in-part of U.S. application Ser. Number 232,390, filed Aug. 15, 1988 now abandoned.

FIELD OF THE INVENTION

This invention relates to improvements in the combustion of liquid hydrocarbons and consequent reduction in $NO_x$ emissions

BACKGROUND OF THE INVENTION

Liquid hydrocarbons are widely used in open flame and internal combustion devices such as oil fired burners and internal combustion engines. One of the common problems associated with such combustion devices is the emission of $NO_x$. Many attempts have been made in the past to reduce $NO_x$ emissions but these normally have resulted in reduction of combustion efficiency.

Oil fired furnaces and boiler arrangements are used world-wide in producing heat and electricity. Normally, petroleum distillates such as fuel oils are used in such oil fired burners. It is highly unusual to burn directly mined crude oil because of the considerable increase in pollutants in the combustion of the products, particularly soot emissions.

It has been appreciated for some time that additives may be included in organic materials which are used in oil fired furnaces and the like. A particularly suitable additive is ferrocene which is one of many of dicyclopentadienyl iron compounds. Examples of these additive constituents are disclosed in U.S. Pat. No. 3,535,356. This patent mentions that ferrocene and its derivatives are valuable additives in various organic compositions particularly hydrocarbons comprising gasolines and other petroleum products including lubricating oils, turbine oils, transformer oils, kerosines, diesel fuels, jet fuels, fuel oils, greases, asphalts, waxes, insecticides and the like. It is not mentioned, however, in this reference what, if any, effect ferrocene may have on the combustion of these products. However, in U.S. Pat. No. 3,122,577 mention is made that ferrocene is suitable as an antiknock agent in gasoline compositions.

U.S. Pat. No. 3,341,311 discloses the use of ferrocene in liquid hydrocarbon fuel oils. The purpose of the ferrocene is to improve the ignition and combustion characteristics of the fuel. The use of such ferrocene in fuel oils as per the examples, reduces the presence of carbon in the combustion gases, and decreases the amount of deposits in the combustion apparatus.

None of these references, however, contemplate the use of ferrocene and its derivatives in liquid hydrocarbons to achieve improvement in the combustion efficiency and reduction in $NO_x$ emissions.

SUMMARY OF THE INVENTION

According to an aspect of the the present invention is directed to a process for burning liquid hydrocarbons in a furnace while maintaining acceptable levels of $NO_x$ emissions, said liquid hydrocarbons having a Conradson carbon content greater than 1%, said process comprising:

i) burning the liquid hydrocarbon in the presence of additive composition in an amount sufficient to improve measurably combustion efficiency in burning the liquid hydrocarbon. The additive comprising:

a) a compound selected from the group consisting of ferrocene and its derivatives represented by the formula:

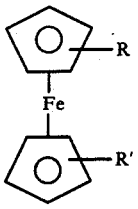

wherein each of R and R', independent of the other, is hydrogen, alkyl, cycloalkyl, aryl or heterocyclic, and b) an organic carrier liquid in which said ferrocene is soluble;

ii) the step of burning the liquid hydrocarbon requiring a level of excess air relative to the quantity of the liquid hydrocarbon being burned, and iii) adjusting downwardly the excess air to reduce $NO_x$ emissions in combustion products while maintaining combustion efficiency at an optimal level due in the presence of the additive, where 1) said level of $NO_x$ emissions in said combustion products, and 2) said level of excess air are less than that occurring for the same level of combustion efficiency in the absence of said additive.

By use of the additive composition in this manner, significant reduction can be achieved in the soot emissions as measured by carbon in the particulate ash as well as increasing combustion efficiency. Surprisingly, it has been discovered that reduction in excess air requirements can be achieved which in turn lowers $NO_x$ emissions.

DETAILED DESCRIPTION OF THE PREFERRED EMBODIMENTS

This invention is applicable in improving combustion of a variety of liquid hydrocarbons, either in open flame or internal combustion. Examples of open flame include various burner systems such as oil fired burners used in heating devices. There are of course, many examples of various types of internal combustion devices which include a variety of gasoline engines as well as jet engines. The liquid hydrocarbons as burned in either open flame or internal combustion, may be selected from a variety of groups. The various types of liquid hydrocarbons may be petroleum distillates designed for combustion or may be waste material of hydrocarbon base. The invention is particularly suited to burning hydrocarbons selected from the group consisting of gasolines and other petroleum products including lubricating oils, turbine oils, transformer oils, kerosines, jet fuels, fuel oils, greases and asphalts. Although the invention as applied in burning these various types of liquid hydrocarbons is applicable in all instances, principles of the invention will be demonstrated with respect to the field of burning crude oils, heavy, medium and light oils and the like. By virtue of using the additive compound, the excess air requirements can be adjusted downwardly to reduce $NO_x$ emissions in burning those various liquid hydrocarbons.

It is appreciated that there are variety of oil fired burner arrangements which are commonly used in heating stations and thermo-electric generating stations.

With the advantages of this invention, crude oils as they are mined may now be burned in these common types of oil fired burner systems which include the multi-storey high boilers used in generating heat and electricity.

The problem with existing systems burning crude oil is the increase in pollutants in the emissions.

In accordance with this invention, the crude oil is treated in preparation for injection through an oil fired burner. Such treatment may include any necessary dilution of the crude oils with combustible solvents and/or heating of the crude oils to reduce the viscosity. Normally there is a holding tank arrangement provided to store the crude oil. The crude oil may or may not be treated in the holding tanks. Preferably, the crude oil is removed from the holding tanks and placed in a temporary storage tank where the smaller quantity can then be treated with suitable solvents if needed and heated if desired. The treated crude oil is then delivered to the oil fired burner by use of suitable pumps and piping arrangement.

In accordance with this invention, the additive composition is introduced to the crude oil before combustion of the crude oil in the oil fired burner. The additive composition is introduced normally to the crude oil, either in the temporary storage tank where the crude oil is initially treated or injected into the piping which delivers the crude oil to the oil fired burner. Optionally, an injection nozzle may be included with the oil fired burner where the additive composition in an atomized form is sprayed with the crude oil as the crude oil is atomized in preparation for combustion. A sufficient amount of the additive composition is included in the crude oil to improve measurably combustion efficiency in burning the oil.

The additive composition comprises:

1) a compound selected from the group consisting of ferrocene and its derivatives represented by the formula:

(I)

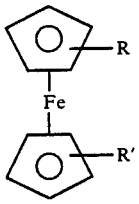

wherein each of R and R', independent of each other, is hydrogen, alkyl, cycloalkyl, aryl or heterocyclic, and 2) an organic carrier liquid in which said ferrocene is soluble.

In respect of Formula I, the term alkyl refers to an alkyl group branched or straight chain of 1 to 10 carbon atoms, such as methyl, ethyl, propyl, n-butyl, hexyl, or heptyl. The term cycloalkyl refers to a lower cycloalkyl group of 3 to 7 atoms, such as cyclopentadyl or cyclohexyl. The term aryl refers to an organic radical derived from an aromatic compound by the removal of one hydrogen atom. Such compounds include phenyl and substituted phenyl such as lower alkyl substituted phenyl. These compounds include tolyl, ethylphenyl, triethylphenyl, halophenyl, such as chlorophenyl, or nitrophenyl. The term heterocyclic refers to pyrrol, pyridyl, furfuryl and the like. The aryl or heterocyclic group generally contains up to about 15 carbon atoms.

Dicyclopentadienyliron is commonly referred to as "ferrocene". Hence the compounds of the above formula I are considered to be ferrocene and its derivatives. The preferred compounds of Formula I include dicyclopentadienyliron, di(methylcyclo-pentadienyl)iron, di(ethylcyclopentadienyl)iron, methylferrocene, ethylferrocene, n-butylferrocene, dihexylferrocene, phenylferrocene, m-tolyferrocene, didecylferrocene, dicyclohexylferrocene and dicyclopentylferrocene.

The organic carrier is of a type in which the selected dicyclopentadienyl iron compound is soluble. Furthermore, the carrier liquid has a high flash point and is of a viscosity at operating temperatures to enable injection when required through the injection nozzles. Preferably, the flash point of the carrier liquid is in excess of 74° F. and has a boiling point in excess of 95° F. The viscosity of the carrier is normally 50 centipoises or less at 20° C. and is preferably in the range of 0.3 to 3.0 centipoises at 20° C. Suitable organic carrier liquids, i.e. solvents, are either of the aromatic or hydrocarbon type. Aromatic solvents include xylenes, toluenes and Solvesol 100 TM (of Imperial Oil) which is a mixture of benzene and naphthalenes having a flash point in the range of 100° F. Suitable hydrocarbons include alcohols, such as hexanol, octanol. Other hydrocarbons includes fuel oils, kerosene, petroleum spirits and the like. The solvents of this nature have a functional flash point with low viscosity. the solvents are stable and the selected additive is soluble. Of course, the selected solvent is non-toxic when combusted.

It is to be appreciated that the additive composition may include a variety of commercial dyes to provide a distinctive color for the composition and distinguish it from others used about the oil-fired furnace operation. The containers for the additive composition should be explosion safe and are suitably handled. The tank containing the additive composition should also be suitably equipped to minimize the risk of explosion and fire.

The amount of additive composition used will vary depending upon the type of crude oil being burned. Generally, the amount of additive composition used will range from 0.1 ppm up to 100 ppm of iron in the composition based on the amount of crude oil being delivered to the oil fired burner. The preferred range of additive composition used is 1 ppm to 5 ppm of iron based on the amount of crude oil delivered to the burner. According to this invention, crude oils having high asphaltene contents can now be burned in oil fired burner arrangements which could not be accomplished in the past. Crude oils containing higher concentrations of asphaltene usually range from about 2 percent up to 15 percent by weight of asphaltene may be employed. Asphaltenes are a class of material having high molecular weight. Common to crude oils, they are a hard solid having a melting point well above 150° C. For example, a member of the class graphamite has a melting point of 315° C. Asphaltenes are soluble in petroleum naphtha in the range of 0 to 60 percent and 50 to 60 percent soluble in $CS_2$. Asphaltenes are readily precipitated by N-heptane which enables analysis of crude oils for the concentration of asphaltene. Although the structure of asphaltenes is not fully understood, it is believed to be an aromatic sheet of 16 fused rings with various substituents. Normally, when crude oils having higher contents of asphaltenes are burned, the asphaltenes do not readily combust and hence greatly add to the overall carbon containing soot emissions when the "dirty" crude oils are burned.

It has been found according to this invention, that soot emissions in burning the dirty crudes can be significantly reduced particularly in the range of approximately a 50 to 80 percent reduction compared to burning the same crude oil without the additive composition. Also, by use of the additive composition the combustion efficiency is appreciably increased which may be in the range of 0.5 percent increase or better depending upon the type of crude oil and its make up. Another significant advantage of this invention is the realization that in using the additive composition, the amount of excess air required in the combustion can be reduced. This provides the unexpected advantage that in using less excess air, a reduction in $NO_x$ emissions can be achieved. This is very important from the stand point of environmental concerns where crude oils now can be effectively burned in standard oil fired burner systems.

Another side benefit realized in using the additive composition of this invention is reduced fouling and corrosion of the oil burner system which maintains optimum heat transfer. This feature also extends equipment life, reduces maintenance costs and minimizes interruption of plant operations. Other efficiency gains include reduced fan power for soot blower operation, the ability to employ effectively a lower quality crude oil and recovery of a marketable ash having lower carbon content. The further benefit in the use of the additive composition in the processes of this invention, is that by reducing soot emissions, there is a corresponding reduction of smaller particulates in the atmosphere. It is well understood that particles smaller than 15 microns may remain suspended in the atmosphere for longer periods and hence can be inhaled. However, by the use of the additive of this invention, there is considerable reduction in the smaller particles of soot in the emissions from the oil fired system.

To test the effectiveness of the additive compositions of this invention and the process of burning crude oil, a pilot plant scale oil fired combustion furnace was used with suitable hardware for testing emissions. Combustion performance was measured by analyzing for the following emissions in the exhaust gases:

carbon dioxide ($COl_2$), carbon monoxide (CO), oxygen ($O_2$), nitrogen oxides ($NO_x$), sulfur dioxide ($SO_2$), and particulates ($RO_x$).

The following analytical techniques were employed to measure values of the above in the exhaust gases. Non-dispersive infrared was used to measure CO and $CO_2$ emissions. Paramagnetism was use to measure oxygen concentration. Chemiluminescence was used to measure the $NO_x$ emissions. Pulsed fluorescence was used to measure the $SO_2$ emissions and the method "Five" in the "Standards of Performance for new Stationary Sources", Federal Register 36, No. 247, 24876, Dec. 23, 1971 was used to measure the particulate material as well as to analyze the following characteristics of the particular material in the emissions; namely:

particulate loading
carbon content
ash content
particle size distribution.

The analytical techniques are uncertain for the values analyzed within the following ranges:

$CO_2 \pm 5\%$
$SO_2 \pm 10\%$
$CO \pm 10\%$
Particle Loading $\pm 10\%$
$O_2 \pm 10\%$
Particle Size $\pm 10\%$
$NO_x \pm 10\%$ .Carbon Content $\pm 10\%$ The pilot plant scale furnace operated on the average of 500 KBtu per hour with an excess air requirement of 26 percent. The furnace gas exit temperature was in the range of 2075° to 2225° F. The combustion air was not preheated in these tests. Based on prior experience it has been found that there is a fairly close relationship between the pilot plant scale oil fired burner and utility scale oil fired burner in terms of effects of additives on composition efficiency. In accordance with this invention, to determine the effectiveness of the process in improving combustion efficiency and achieving the other features and advantages thereof, a representative crude oil was obtained for testing. The crude oil (identified as Italian Vega) had the following characteristics as set out in Table I.

TABLE I

| Fuel Characteristics | Heavy (Vega) Petroleum |
|---|---|
| Heating Value | 18,393 |
| Proximate Analysis (weight %, dry) | |
| Volatile Matter | — |
| Fixed Carbon | — |
| Ash | 0.06 |
| Ultimate Analysis (weight %, dry) | |
| Carbon | 80.72 |
| Hydrogen | 9.07 |
| Nitrogen | 0.35 |
| Sulfur | 2.30 |
| Oxygen | 7.50 |
| Ash | 0.06 |
| Asphaltene Content (weight %, dry) | 15.00 |
| Vanadium (ppm, weight) | 50.00 |

EXAMPLE 1

In view of the organic carrier liquid having the ability to affect the overall combustion process, an exemplary carrier was first tested to determine such impact. According to this example, the carrier liquid used was xylene. The additive composition consisted of 5000 ppm by weight of ferrocene iron distributed in a xylene carrier based on the amount of crude oil delivered for any amount of time. The composition was diluted to provide the necessary appropriate iron concentrations in the crude oil before introduction to the oil fired furnace. Xylene was therefore used with and without ferrocene to provide the following test results summarized in Table II.

TABLE II

RESULTS OF COMBUSTION TESTS ON VEGA PETROLEUM PRETREATED WITH ADDITIVE

| Combustion Performance Characteristic | Pretreated Vega Petroleum: Xylene (0 ppm iron) | Pretreated Vega Petroleum: Additive (5 ppm iron) |
|---|---|---|
| Furnace Gas Exit Temperature (F.) | 2120 | 2190 |
| $O_2$ (%, volume) | 5.0 | 4.7 |
| $CO_2$ (%, volume) | 13.0 | 13.3 |
| CO (ppm, volume) | 30 | 30 |
| $NO_x$ (ppm, volume) | 470 | 500 |
| $SO_2$ (ppm, volume) | 1400 | 1360 |
| Carbon in Particulate Ash (%, weight) | 17 | 2.61 |
| Average Ash Particle Size (microns) | 10 | 5 |
| Particulate Loading (pounds/million Btu) | 0.02 | 0.02 |
| Combustion Efficiency (%) | 99.43 | 99.86 |

The apparent effect of the additive composition at a 5 ppm iron level on the normal performance characteristics of the base line Vega oil crude flame can be summarized as follows:

1) Although acceptable levels of CO in the exhaust gases remained unchanged, the carbon in the particulate ash was reduced dramatically by as much as 85 percent.
2) The reduced carbon particulate levels translated into about a 0.43 percentage point improvement in the already acceptably high (99 +percent) baseline combustion efficiency.
3) The ash loading remained essentially unchanged;
4) The average size of the particulates decreased dramatically by as much as 50 percent.
5) $NO_x$ emission remained relatively unchanged which is important from the stand point of realizing that excess air requirement may be reduced.
6) $SO_2$ emissions remained relatively unchanged.

To better summarize the results of a measurable effect, the following Table III provides a listing of the above noted properties.

TABLE III

EFFECT OF ADDITIVE ON VEGA OIL COMBUSTION

| Test Parameter | Change in Combustion Performance Upon use of Additive |
|---|---|
| Test Fuel | Oil |
| Additive Iron Concentration (ppm) | 5 |
| CO (ppm, volume) | 0 |
| $NO_x$ (ppm, volume) | +30 |
| $SO_2$ (ppm, volume) | −40 |
| Ash Loading (%) | 0 |
| Average Ash Particle Size (%) | −50 |
| Fine Particle Ash (%) | — |
| Carbon in particle Ash (%) | −85 |
| Combustion Efficiency (%, absolute) | +0.43 |

As is appreciated, it should be noted that combustion efficiency as measured and identified in the above tables relates to carbon combustion efficiency. Hence, combustion efficiency may be loosely defined as the extent to which elemental carbon in the fuel is oxidized to $CO_2$. Based on these test results, a difficult to burn out, high asphaltene, low vanadium heavy crude oil was efficiently combusted to match typical utility conditions. By increasing the combustion efficiency, the amount of thermal energy extracted from the crude oil was also increased thereby reducing fuel costs. This is significant from the stand point that crude oil costs are approximately half the cost of fuel oil normally used in oil fired burners. By using the additive composition of this invention, black smoke problems are virtually eliminated. Electrostatic precipitator performance is improved and excess air requirements as already noted, are minimized. In most situations, an operator of an oil fired burner system cannot reduce the excess air level requirements of a boiler during heavy oil combustion because a high level of particulates results which is manifested in a black, smokey plume. By using the additive composition of this invention, one can maintain high levels of combustion efficiency and reduce levels of excess air. Tests have shown that reducing the excess air level results in a reduction of $NO_x$ emissions with very little change in the combustion efficiency. The additive allows combustion to occur at low excess air levels and, in turn, lowers the thermal $NO_x$ emissions. This invention improves burning of high asphaltene heavy oil while complying with $NO_x$ and other emission standards with the additional benefits of minimal corrosion, slagging, fouling and improved overall plant efficiency.

Having demonstrated the principals of the invention with respect to the combustion of crude oils, it is appreciated that the principles of the invention apply equally to the combustion of various other types of liquid hydrocarbons of the above mentioned group to reduce $NO_x$ emissions. The additive is particularly suitable for use in the treatment of other oils such as the heavy oils and medium oils having a Conradson carbon content greater than 1%. It is appreciated, of course, that the above crude oil has a Conradson number considerably greater than 1%.

The effectiveness of the fuel additive, according to this invention, has also been tested in other types of oils, such as the oils having the following characteristics outlined in Table IV.

TABLE IV

TEST OIL CHARACTERISTICS

| Fuel Characteristic | Light Oil | Heavy Oil |
|---|---|---|
| Heating value (Btu/pound, dry) | 18,200 | 17,300 |
| Viscosity ($mm^2$/sec at 100 C.) | 2.2 | 39 |
| Flash Point (C.) | 54 | 65 |
| Ash (weight %, dry) | <0.001 | 0.008 |
| Sediments (weight %, dry) | <0.1 | 0.20 |
| Sulfur (weight %, dry) | 0.4 | 2.40 |
| Conradson Carbon (weight %, dry) | 0.03 | 18 |
| Vanadium (ppm, weight) | <1 | 100 |

The furnace used in testing the oils of Table IV is the same as the furnace used in Example 1. The furnace is operated through at levels of 10% excess air and 26% excess air. The furnace gas exit temperature was in the range of 2075° and 2275° F. There was no preheating of the combustion air. The firing rate was at 500 KBtu/-hour. The duration of the test for the light oil was 12 hours, whereas the duration of the test for the heavy oil was 6 hours. The results of combustion of the heavy oil and the light oil of Table IV are set out in the following Tables V and VI.

TABLE V

RESULTS OF COMBUSTION TESTS ON HEAVY OIL PRETREATED WITH 0.2 TO 5 PPM OF IRON IN FERROCENE AT VARYING LEVELS OF EXCESS COMBUSTION AIR (10-26%)

| | Agent Pretreated Into Oil | | | | | |
|---|---|---|---|---|---|---|
| | Xylene or (0 ppm Iron) @ Excess Air | Ferrocene (0.2 ppm Iron) @ Excess Air | Ferrocene (1 ppm Iron) @ Excess Air | | Ferrocene (5 ppm Iron) @ Excess Air | |
| | 10% | 26% | 10% | 26% | 10% | 26% |
| Furnace Exit Temperature (F.) | 2200 | 2095 | 2260 | 2150 | 2270 | 2175 |
| $O_2$ (%, volume) | 2.3 | 4.8 | 2.2 | 4.6 | 2.6 | 4.9 |
| $CO_2$ (%, volume)[a] | 16.6 | 16.8 | 16.8 | 16.8 | 16.9 | 16.9 |
| CO (ppm, volume)[a] | 40 | 30 | 30 | 25 | 37 | 26 |

TABLE V-continued

RESULTS OF COMBUSTION TESTS ON HEAVY OIL PRETREATED WITH 0.2 TO 5 PPM OF IRON IN FERROCENE AT VARYING LEVELS OF EXCESS COMBUSTION AIR (10-26%)

| | Agent Pretreated Into Oil | | | | | |
|---|---|---|---|---|---|---|
| | Xylene or (0 ppm Iron) @ Excess Air | Ferrocene (0.2 ppm Iron) @ Excess Air | Ferrocene (1 ppm Iron) @ Excess Air | | Ferrocene (5 ppm Iron) @ Excess Air | |
| | 10% | 26% | 10% | 26% | 10% | 26% |
| $NO_x$ (ppm, volume)[a] | 275 | 315 | 280 | 355 | 300 | 400 |
| $SO_2$ (ppm, volume)[a] | 1600 | 1575 | 1550 | 1625 | 1625 | 1600 |
| Carbon in Particulate Ash (%, weight) | 16.5 | 7.3 | 0.68 | 0.73 | 0.40 | 0.43 |
| Particulate Loading (pounds/million Btu) | 0.06 | 0.06 | 0.06 | 0.06 | 0.06 | 0.06 |
| Average Particulate Size (microns) | 10 | 10 | 5 | 5 | 5 | 5 |
| Combustion Efficiency (%) | 98.32 | 99.43 | 99.90 | 99.90 | 99.95 | 99.95 |

[a] = As-measured concentrations have been corrected to a 0% excess oxygen, or "air-free" basis.

TABLE VI

RESULTS OF COMBUSTION TESTS ON LIGHT OIL PRETREATED WITH 0.2 TO 5 PPM OF IRON IN FERROCENE AT VARYING LEVELS OF EXCESS COMBUSTION AIR (10-26%)

| | Agent Treated Into Oil | | | |
|---|---|---|---|---|
| | Xylene (0 ppm Iron) Excess Air | | Ferrocene (0.2-5 ppm Iron) Excess Air | |
| | 10% | 26% | 10% | 26% |
| Furnace Exit Temperature (F.) | 2230 | 2200 | 2220 | 2250 |
| $O_2$ (%, volume) | 2.2 | 4.8 | 2.2 | 4.6 |
| $CO_2$ (%, volume)[a] | 16.8 | 16.6 | 16.6 | 16.8 |
| CO (ppm, volume)[a] | 40 | 35 | 40 | 35 |
| $NO_x$ (ppm, volume)[a] | 100 | 110 | 105 | 115 |
| Carbon in Particulate Ash (%, weight) | 5.2 | 3.2 | 3.2 | 3.1 |
| Particulate Loading (pounds/million Btu) | 0.0006 | 0.0004 | 0.0004 | 0.0004 |
| Average Particulate Size (microns) | <1 | <1 | <1 | <1 |
| Combustion Efficiency (%) | 99.99+ | 99.99+ | 99.99+ | 99.99+ |

[a] = As-measured concentrations have been corrected to a 0% oxygen 35 basis.

As shown in Table V, the heavy oil was tested at 0, 0.2, 1 and 5 ppm based on iron in the additive. It was found that 0.2 ppm iron had no effect on the combustion efficiency so that the values reported for 0 ppm and 0.2 ppm of the additive are the same. At levels of 1 ppm of the additive, significant changes are noted with further difference at the high level of 5 ppm of the additive. At 1 to 5 ppm of the additive, there was 90% to 97% reduction in particulate carbon with a corresponding increase in combustion efficiency from 0.05 to 1.6 %. The average particulate size was reduced by 50%, whereas $NO_x$ emissions increased by only 5 to 85 ppm. It is noted, however, at the levels of 1 ppm and 5 ppm the desired combustion efficiency of greater than 99% can be attained at the reduced excess air levels of 10% where the $NO_x$ emissions are very close to the value of $NO_x$ in additive-free oil burned in 10% excess air. Hence the increase in $NO_x$ emissions at 26% excess air can be offset by burning the oil with the additive at 10% excess air without any significant reduction in combustion efficiency. The incremental reduction in particulate carbon and the incremental increase in combustion efficiency provided by the additive of this invention were greater at lower levels of Carbonex, that is 1 ppm versus 5 ppm, and at lower levels of excess air, that is 10% versus 26%. The observed reduction in particulate size was independent of the additive content above 1 ppm. The use of the additive of this invention had no apparent effect on the $CO_2$ or $SO_2$ emissions, or particulate loadings.

The combustion results reported in Table VI for the light oil shows the results achieved within the accuracy of the tests to demonstrate very little difference between combustion efficiencies at 0 ppm additive through to 5 ppm additive. However, the additive did affect other parameters. The additive of this invention in light oil had impact on the normal combustion of other performance characteristics of the light oil. Treatment of the light oil with 0.2 ppm of the additive and firing at 10% excess air reduced acceptable particulate carbon by 38% and reduced acceptable particulate loading by 33%. There was no significant effect on the CO, $NO_x$, particulate size or the already ultra high and acceptable combustion efficiency of 99.99%.

It is apparent that the use of the additive of this invention has a superior effect on the heavy oils and crude oils. These oils have a Conradson carbon content greater than 1%. The additive of this invention does, however, have an effect on the burning of the light oils. The additive of this invention at a concentration of less than 1 ppm enhances carbon burnout in an already efficiently burning light oil flame, whereas in the heavy oils, the use of the additive at a concentration in the range of 1 to 5 ppm reduce the carbon in the particulate by 90%, thereby improving combustion efficiency up to 1.6%. This is a significant increase in combustion efficiency which can result in the saving of large sums of money in the operation of an electric or thermal generating plant over the span of a year.

As with the crude oil, the use of the additive of this invention in the heavy oils and the like, aside from providing a reduction of carbon in the particulates, also provides the advantages in eliminating opacity in the smoke from the furnace, improving performance of electrostatic precipitators and minimizing excess air requirements. The reliability and economics of oil fired burner operation is improved as a result of these secondary effects. By providing lower $NO_x$ emissions at the desired combustion efficiency, the additive of this invention then minimizes corrosion and fouling and improves overall plant efficiency.

Although preferred embodiments of the invention have described herein in detail, it will be understood by those skilled in the art that variations may be made thereto without departing form the spirit of the invention or the scope of the appended claims.

I claim:

1. A process for burning liquid hydrocarbons in a furnace while maintaining acceptable levels of $NO_x$ emissions, said liquid hydrocarbons having a Conradson carbon content >1%, said process comprising:

i) burning said liquid hydrocarbon in the presence of an additive composition in an amount sufficient to improve measurably combustion efficiency in burning said liquid hydrocarbon and reduce soot emissions;

said additive comprising;

a) a compound selected from the group consisting of ferrocene and its derivatives represented by the formula:

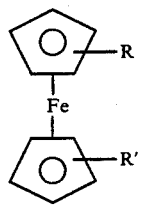

wherein each of R and R', independent of the other, is hydrogen, alkyl, cycloalkyl, aryl or heterocyclic, and b) an organic carrier liquid in which said ferrocene is soluble, ii) said step of burning said liquid hydrocarbon requiring a level of excess air relative to the quantity of said liquid hydrocarbon being burned;

iii) adjusting downwardly said excess air requirement to reduce $NO_x$ emissions in combustion products while maintaining combustion efficiency at an optimal level in the presence of said additive where 1) said level of $NO_x$ emissions in said combustion products, and 2) said level of excess air are less than that occurring for the same level of combustion efficiency in the absence of said additive.

2. A process of claim 1 wherein said additive composition is added to said liquid hydrocarbon prior to combustion.

3. A process of claim 1 wherein said liquid hydrocarbon is selected from the group consisting of crude oils, heavy oils, lubricating oils, turbine oils, transformer oils, kerosine, jet fuels, fuel oils, greases and asphalts.

4. A process of claim 1 for reducing $NO_x$ emissions in the combustion of crude oils in an oil-fired burner of said furnace, said crude oil having a high asphaltene content in the range of 2 to 20% by weight of said crude oil to reduce soot emissions while simultaneously reducing excess air requirements during such combustion, said process comprising:

i) treating said crude oil in preparation for injection through an oil-fired burner including any necessary dilution with combustible solvents and heating to reduce viscosity.

ii) delivering said treated crude oil to said oilfired burner, iii) burning said crude oil in said oil-fired burner in the presence of said additive composition in an amount sufficient to improve measurably combustion efficiency in burning said crude oil.

5. A process of claim 1, 3 or 4 wherein said sufficient amount of said additive composition comprises 0.1 ppm up to 100 ppm of iron in said composition based on the amount of liquid hydrocarbon being delivered to said furnace and said selected liquid hydrocarbon has a Conradson carbon content greater than 1%.

6. A process of claim 4 wherein said crude oil is diluted with a solvent to improve its atomization characteristics in said burner.

7. A process of claim 1 or 4 wherein said sufficient amount of said additive composition comprises 1 ppm to 5 ppm of iron is said composition based on the amount of liquid hydrocarbon being delivered to said furnace.

8. A process of claim 1 or 4 wherein said ferrocene compound is selected from the group consisting of dicyclopentadienyliron, di(methylcyclopentadienly)iron, di(ethylcyclopentadienyl)iron, methylferrocene, ethylferrocene, n-butylferrocene, dihexylferrocene, phenylferrocene, m-tolyferrocene, didecylferrocene, dicyclohexylferrocene and dicyclopentylferrocene.

9. A process of claim 8 wherein said compound is dicyclopentadienyliron.

10. A process of claim 9 wherein said organic carrier is selected form the group consisting of high flash point aromatic solvents, hydrocarbon solvents and petroleum based solvents.

11. A process of claim 10 wherein reduction in soot emission results in carbon in particulate ash decreasing by approximately 50 to 80 percent compared to burning said crude oil without said additive composition.

12. A process of claim 4 or 10 wherein said combustion efficiency is increased by approximately 0.5% compared to burning said crude oil without said additive composition.

* * * * *